US008256528B2

(12) United States Patent
Oesterle et al.

(10) Patent No.: US 8,256,528 B2
(45) Date of Patent: Sep. 4, 2012

(54) VIBRATION-DAMPED HOLDER FOR ADDITIONAL HANDLE

(75) Inventors: Markus Oesterle, Aspach (DE); Thomas Robieu, Schwaikheim (DE)

(73) Assignee: AEG Electric Tools GmbH, Winndenden (DE)

( * ) Notice: Subject to any disclaimer, the term of this patent is extended or adjusted under 35 U.S.C. 154(b) by 184 days.

(21) Appl. No.: 12/467,898

(22) Filed: May 18, 2009

(65) Prior Publication Data

US 2009/0283283 A1 Nov. 19, 2009

(30) Foreign Application Priority Data

May 19, 2008 (EP) ..... 08009186

(51) Int. Cl.
*B25D 17/24* (2006.01)

(52) U.S. Cl. ..... 173/162.2; 173/162.1

(58) Field of Classification Search ..... 173/162.1, 173/162.2

See application file for complete search history.

(56) References Cited

U.S. PATENT DOCUMENTS

| | | | | | |
|---|---|---|---|---|---|
| 4,236,310 | A | * | 12/1980 | Muller | 30/276 |
| 4,611,671 | A | * | 9/1986 | Hansson | 173/162.2 |
| 4,819,742 | A | * | 4/1989 | Driggers | 173/162.2 |
| 4,825,548 | A | | 5/1989 | Driggers | |
| 5,025,870 | A | * | 6/1991 | Gantner | 173/162.2 |
| 5,157,807 | A | * | 10/1992 | Keller et al. | 16/431 |
| 5,170,532 | A | * | 12/1992 | Holmin et al. | 16/431 |
| 5,409,560 | A | * | 4/1995 | Hammer et al. | 156/248 |
| 5,774,993 | A | * | 7/1998 | Schlessmann | 30/276 |
| 5,797,488 | A | * | 8/1998 | Yemini | 206/349 |
| 6,112,831 | A | | 9/2000 | Gustafsson | |
| 6,155,916 | A | * | 12/2000 | Rudolf et al. | 451/344 |
| 6,209,723 | B1 | * | 4/2001 | Fields | 206/373 |
| 6,375,171 | B1 | * | 4/2002 | Zimmermann et al. | 267/137 |
| 6,421,880 | B1 | * | 7/2002 | Prajapati et al. | 16/431 |
| 6,446,421 | B1 | | 9/2002 | Kramer et al. | |
| 2001/0011846 | A1 | * | 8/2001 | Krondorfer et al. | 310/17 |
| 2002/0197939 | A1 | | 12/2002 | Frauhammer et al. | |
| 2006/0185867 | A1 | * | 8/2006 | Frauhammer et al. | 173/162.1 |
| 2009/0294144 | A1 | * | 12/2009 | Frauhammer et al. | 173/162.2 |

FOREIGN PATENT DOCUMENTS

| | | | |
|---|---|---|---|
| DE | 87 01 722 | U1 | 4/1987 |
| DE | 199 25 281 | A1 | 12/2000 |
| DE | 10 2005 059 180 | A1 | 6/2007 |
| EP | 0 156 387 | A | 10/1985 |
| EP | 0 284 659 | A | 10/1988 |
| GB | 2 376 913 | A | 12/2002 |
| WO | WO 97/02930 | A | 1/1997 |
| WO | WO 2008/099744 | A1 | 8/2008 |
| WO | WO 2009/047060 | | 4/2009 |

* cited by examiner

*Primary Examiner* — Brian D Nash

(74) *Attorney, Agent, or Firm* — Knobbe Martens Olson & Bear LLP

(57) ABSTRACT

A damper for mounting between a power tool, having an axis of vibration, and a handle. The damper includes a damping arrangement for damping impacts and a spacer. The spacer is dimensioned so that, when the damper is mounted to the power tool, a ratio of a first distance between the axis of vibration and the handle to a second distance between the axis of vibration and the damping arrangement is at least 2:1. Further, a handle having such a damper for a power tool, as well as the corresponding power tool having such a handle, are described.

11 Claims, 2 Drawing Sheets

VIBRATION-DAMPED HOLDER FOR ADDITIONAL HANDLE

REFERENCE TO RELATED APPLICATIONS

This application is related to, and claims priority from, European Patent Application No. 08 009 186.1, filed May 19, 2008, entitled "VIBRATION-DAMPED HOLDER FOR ADDITIONAL HANDLE," the entirety of which is incorporated by reference herein and made a part of the present specification.

BACKGROUND OF THE INVENTION

1. Field of the Invention

The invention relates to a damper for mounting between a power tool having an axis of vibration, on the one hand, and a handle device for the power tool, on the other hand, wherein the damper comprises a damping means for damping impacts (absorbing shocks) and a distancing means. The invention further relates to a handle for a power tool having an axis of vibration and to a power tool having an axis of vibration, in particular a drill or impact drill or a hammer drill.

2. Description of the Related Art

Hand-operated machine tools such as power tools, for example angle grinders or power cutters (cut-off-saw), polishing machines, drills, hammer drills or the like comprise a main handle formed on or fixed to a motor housing or the like. The machine tool is held and guided at the main handle. Additionally, it may be useful to provide an additional handle for the other hand of the user. Such an additional handle is usually releasably fixed to the transmission housing of the machine tool, for example. Configured as fixed stock handle it protrudes radially with respect to the longitudinal axis of the machine tool and facilitates guiding in difficult processing tasks.

Vibrations created due to operation propagate from the machine tool via the additional handle, in particular, to the hand or the arm of the user. In order to reduce the level of vibrations acting upon the user, known stock or additional handles having elastic damping elements are provided. An example for an additional handle known from the prior art for reducing the level of vibrations acting upon the user is described in EP 1 867 443 A1.

The vibrations of the power tool, for example a drill, impact drill or hammer drill, are generated along an axis of vibration. In the case of a hammer drill, the axis of vibration denotes for example the axis along which a chiseling tool or the like will impact onto the substrate to be processed. The shocks and vibrations generated here are transmitted both directly via the tool housing and the main handle formed thereon and via the additional handle to the hands or arms of the user. Due to the partly enormous shocks and vibrations arising when using a corresponding power tool, these represent high stresses, especially onto the joints of the user. A damping of these vibrations is absolutely necessary, in particular for the purposes of occupational health so as to effectively avoid permanent damages to health resulting from the use of such a power tool.

The damping effect of the damping elements known from the prior art is, however, not optimal. A handle part and a damping element that are connected to the machine tool by an attachment part are provided. In additional handles of the state of the art, the arrangement of the damping element is provided, in different configurations, in a handle part or as a connection between a handle part and an attachment part. Moreover, in the state of the art, a tear-off protection is generally recognized as necessary, too, so that upon damage of the damping element a tearing-off of the handle part can be prevented. The tear-off protections described in the prior art are, however, complex and expensive.

GB 2 376 913 A describes a damper for an additional handle of a hand-held tool. The damper contains a support guiding the handle in a direction of motion and limiting the relative motion between the handle and the tool. One or more springs damp impacts in the direction of motion.

Overall, the damping effect of the additional handle having elastic damping elements as described in the state of the art is not satisfactory.

SUMMARY OF THE INVENTION

It is an object of the present invention to provide a damper pertaining to the above-mentioned technical field, a handle for a power tool and a power tool having a handle, wherein vibrations created along an axis of vibration are damped (attenuated) particularly well.

A solution to the above object is provided by the features of one or more of the claims. According to the invention, the distancing means, or spacer, is dimensioned so that, when the damper is mounted, a ratio of first distance between the axis of vibration and the handle means and a second distance between the axis of vibration and the damping means, or damping arrangement, is at least 2:1. In other words, the distance between the axis of vibration and the handle means is at least, preferably more than twice as large as the distance between the axis of vibration and the damping means. The damping means is arranged between the handle means and the distancing means. The axis of vibration constitutes an axis along which vibrations may occur when a power tool is operated. An example for such an axis of vibration is the axis around which a drill of an impact drill rotates, or the impact axis of a hammer drill. Because the vibrations arising along this axis are particularly large and by far exceed in their intensity possible vibrations of the electric motor or other peripherals of the power tool, it is of particular importance to dampen just these strong vibrations as far as possible in their propagation toward a hand or an arm of a user of the power tool. Thus, the distance between the handle means and the damping means is chosen so that the damping means dampens vibrations in a particularly efficient manner. To that end, the distance of the handle means from the damping means is to be made as large as possible, within practical limitations, in relation to the distance of the damping means from the location in which the vibrations to be damped are created, wherein a comfortable use of the power tool is not to be disregarded. Here, the distancing means may be provided as a separate element as well as integrally formed with the damping means and/or the handle means.

Advantageously, the damping means comprises an elastic (resilient) element and may moreover preferably comprise a stopper element. Such elements are advantageous because the damping means may show symptoms of fatigue during its operation, which in an extreme case may lead to the destruction of the damping means and possibly the tearing-off of the handle means. The elastic element of the damping means is intended for damping by deforming itself in interaction with the vibrations of the power tool and by thus passing on only weakened vibrations to the handle means.

Preferably, the damping means, which may be cylindrical, comprises a cladding, in particular a multi-part cladding, which cladding preferably comprises a ring-shaped envelope, preferably a metal ring. Such a cladding is for example particularly well-suited to serve as stopper element for the damping means. The damping means, in particular those parts cooperating with the elastic element, may abut on the cladding in an initial (basic) state which does not need to absorb any application of force by dynamic deformation of the elastic element. Thus, the cladding preferably surrounds the parts cooperating with the elastic element so that these are held in the cladding when the elastic element fails, for example when it tears off or breaks. Thus, one can prevent that the handle element is unintentionally released from the power tool in which the damper is mounted. A ring-shaped envelope of the cladding is intended for additional stability which is provided in special measure by a metal ring. A robust cladding not only serves to protect the elastic element which may be received in the cladding, but also has an especially high strength which can be of particular relevance in a use of the cladding as stopper element.

Advantageously, the damper further comprises an attachment means for attaching the damper to the power tool, which is in particular provided with a clamping means. An attachment means on the side of the damper has the advantage that the damper may be used with a plurality of power tools. Thus, it is also possible to subsequently equip a power tool with the inventive damper without problems. Moreover, in the advantageous configuration of the attachment means as clamping means no thread or the like on the electric tool is necessary. Rather, the damper can be clamped directly onto the housing of the electric tool and is, thus, also particularly easy to detach again, for example for transport. Apart from that, the attachment means may be formed by a screw thread which can be screwed into the housing of the electric tool.

A handle according to the invention for a power tool having an axis of vibration comprises a damper which can be configured as described above, and a handle means connected with the damper. Together with the handle means, the damper forms a handle for a power tool, by means of which the power tool may be guided and which attenuates vibrations of the power tool arising along an axis of vibration particularly well. Advantageously, the handle is characterized in that the damping means, the distancing means and the handle means, in particular in this order, are arranged linearly one after the other. The damping means, the distancing means and the handle means are, thus, arranged in succession one after the other so that the ratio of the distances between the handle means and the axis of vibration of a power tool to which the handle is attached and the distance between the damping means and the axis of vibration can be adjusted particularly well. The damping means is thus situated between the handle means and the axis of vibration, and the distancing means is situated between the damping means and the handle means, whereby the distance between the damping means and the handle means can be adjusted so that the desired ratio of the distances between the handle means and the axis of vibration, and the damping means and the axis of vibration may be maintained.

It is particularly preferable that the damping means, the distancing means and the handle means are respectively connected to each other by screw fasteners. Thus, in a particularly simple manner, it is possible to subsequently upgrade also an existing handle without a damping means of the invention with such damping means. Besides, it is also possible that single elements of the handle are designed integrally with each other. This applies for example to the distancing means and the handle means as well as the handle means and the damping means. The damping means may also be integrally formed with the attachment means, for example.

A power tool according to the invention having an axis of vibration, in particular a drill or an impact drill or a hammer drill, is characterized in that it comprises the above-described handle. Such a power tool features a particularly good vibration damping of the vibrations arising along the axis of vibration. The power tool thus complies with particularly high demands in occupational health and allows a continuous use of the power tool without having to fear damages to the health of the user.

Advantageously, the power tool is characterized in that a first distance of the handle means of the mounted handle to the axis of vibration is larger than a second distance of the damping means of the mounted handle to the axis of vibration, wherein a ratio of the first distance and the second distance is at least 2:1. A power tool in which the distances between the axis of vibration and the handle means, and the axis of vibration and the damping means are chosen such that the first distance is at least twice as large as the second distance, features a particularly good attenuation of the vibrations of the mounted handle. It is particularly preferred that the handle is manually detachable, in particular by means of a clamping mechanism. In addition, such a power tool features a high flexibility because the handle is manually detachable, for example for transport purposes. "Manually detachable" in this case means that no additional tool is necessary to detach the handle from the power tool. The above-described clamping mechanism constitutes a particularly easy way to configure the handle as manually detachable. Apart from that, however, also screw connections or similar attachment methods are possible.

Further advantageous embodiments of the invention will become evident from the attached detailed description of the figures as well as from the claims in their entirety.

DETAILED DESCRIPTION OF THE PREFERRED EMBODIMENTS

Figure 1:
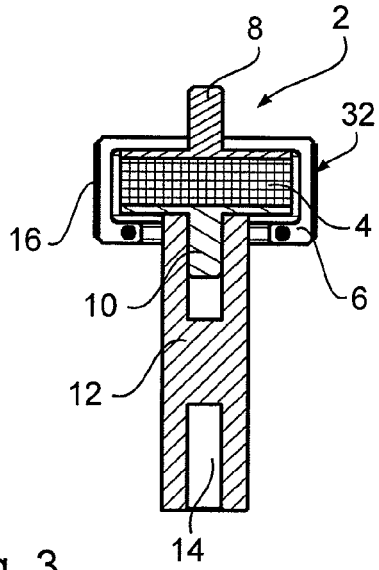
FIG. 1 shows a damper for mounting between a power tool and a handle means.

FIG. 1 shows a sectional view of a damper 2 having a damping means, such as a damping arrangement 32, and a distancing means, such as a spacer 12. The section through the damper 2, which has a generally cylindrical form, is substantially taken along the cylinder axis of the damper 2. In the upper part of the figure there is a damping means 32 which has an elastic element 4, a first connecting element 8 and a second connecting element 10 in a two-part cladding 6. The cladding forms a cylinder having a first diameter in which the elastic element 4 shown in FIG. 1 is also formed cylindrically and is inserted therein. In this exemplary embodiment, the elastic element 4 is formed of NBR (nitrile rubber), wherein the elastic element 4 may also be formed of other elastic materials, a coil spring or the like.

One of the connecting elements 8, 10 is respectively attached to the upper and lower front faces of the cylindrical elastic element 4. The first connecting element 8, which is loaded by the elastic element 4 with a pressure against the first front face of the cylindrical cladding 6, is attached at the upper front side of the elastic element 4. The first connecting element 8 comprises a saucer-shaped base which has a base surface corresponding to the elastic element 4. As screw forming a second part of the connecting element 8 is integrally formed with the base. The screw penetrates the first front face of the cladding 6 towards the outside. Thus, the screw of the connecting element 8 may be fixed to an attachment means by means of a corresponding internal thread, whereby the cladding 6 and the elements contained therein are also fixable to the attachment means.

A second connecting element 10 configured analogously to the first connecting element 8 is located at the lower front face of the cylindrical elastic element 4, wherein a screw-shaped part of the second connecting element 10, which is also integrally formed with a saucer-shaped base, penetrates through the lower front face of the cladding 6 of the damping means 32 to the outside. In doing so, the elastic element 4 is clamped between the bases of the two connecting elements 8, 10, whereby the connecting elements 8, 10 are pressed against the abutting upper and lower front faces of the substantially cylindrical cladding 6, respectively.

Due to the elasticity of the elastic element 4, both a movement of the connecting elements 8, 10 in the direction of the cylinder axis toward the interior of the cladding 6 and a tilting movement with respect to this cylinder axis may be performed. Additionally, a torsional movement about the cylinder axis may be performed. The elastic element 4 cushions (absorbs) such a motion. Hence, a motion in all directions (3-dimensional motion) may be absorbed.

In cooperation with the base part of the connecting elements 8, 10, the cladding 6 at the same time serves as stopper element for the damping means 42. The cladding 6 is reinforced along its cylinder barrow by means of a metal ring 16. The metal ring 16 allows a particularly high strength of the cladding 6 with respect to radial motions of the cladding. Especially in the case of a two-part cladding 6, composed of two half cylinders, the metal ring 16 allows a very high strength of the cladding 6 in an easy way.

In the embodiment shown in FIG. 1, the distancing means 12 that is also substantially cylindrical is attached at the second connecting element 10. A second diameter of the cylindrical distancing means 12 is substantially smaller than the first diameter of the damping means 32. The distancing means 12 comprises an internal thread which corresponds to the external thread of the screw of the connecting element 10. Thus, the distancing means may be easily attached to the damping means 32. At its end opposite to the damping means 32, the distancing means 12 moreover comprises a further connection possibility 14 configured as an internal thread, for example for connection to a handle means.

Figure 2:
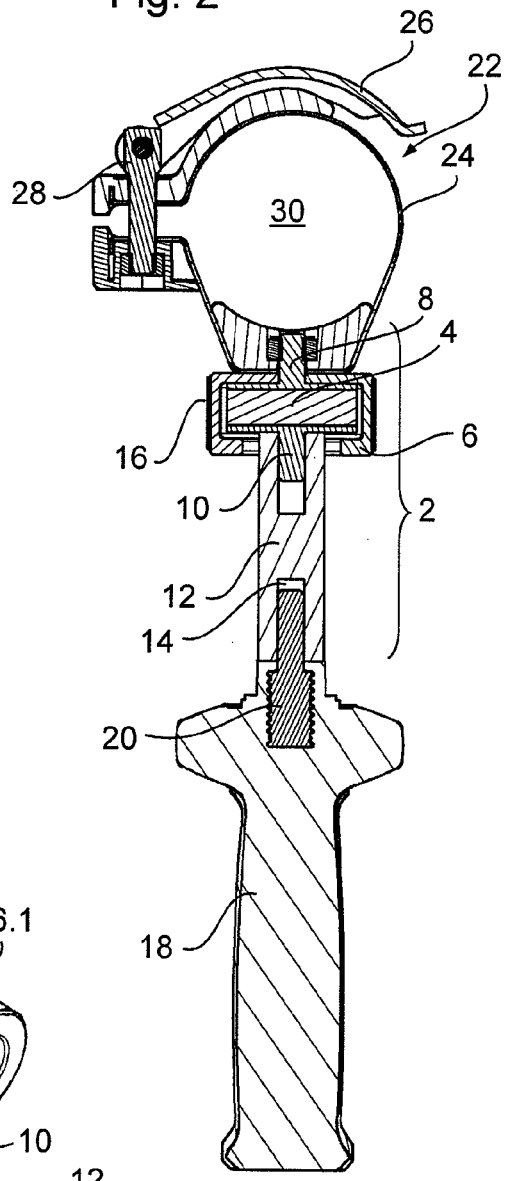
FIG. 2 shows a handle having a damper.

FIG. 2 shows a sectional view of a handle according to an embodiment of the invention having the damper 2 shown in FIG. 1. In the embodiment shown in FIG. 2, the first connecting element 8 of the damper 2 is connected to an attachment means, such as an attachment mechanism 22.

The attachment means 22 comprises at its side facing the damper 2 a recess provided with an internal thread, which serves for attaching the damper 2 to the attachment means 22. The attachment means 22 comprises an open metallic ring 24 which surrounds a substantially circular space 30. The space 30 serves for receiving a part of the power tool 34 to which the handle shall be fastened. The open metal ring 24 is held together by means of a clamping means, such as a clamping mechanism 28, having a clamping lever 26. By means of the clamping means 28 operated by the lever 26, the circumference of the ring 24 may be reduced. In this way, a tension between the handle and the power tool 34 can be created so that the handle is connected releasably and in an assembly-free way with the power tool 34.

A handle means, such as a handle 18, is attached to the distancing means 12 of the damper 2 via the recess 14 and a screw-shaped connecting element 20. The distancing means 12 provides for the distance between the handle means 18 and the elastic element 4 of the damping means 32 to lie in a sufficiently large ratio to the distance between the center point of the space 30 of the attachment element 22 and the elastic element 4. Preferably, the handle is made from a single synthetic resin and coated with a resilient layer, in particular, a rubber layer, which allows a secure grip for the user and imparts a pleasant grip sensation.

Figure 3:
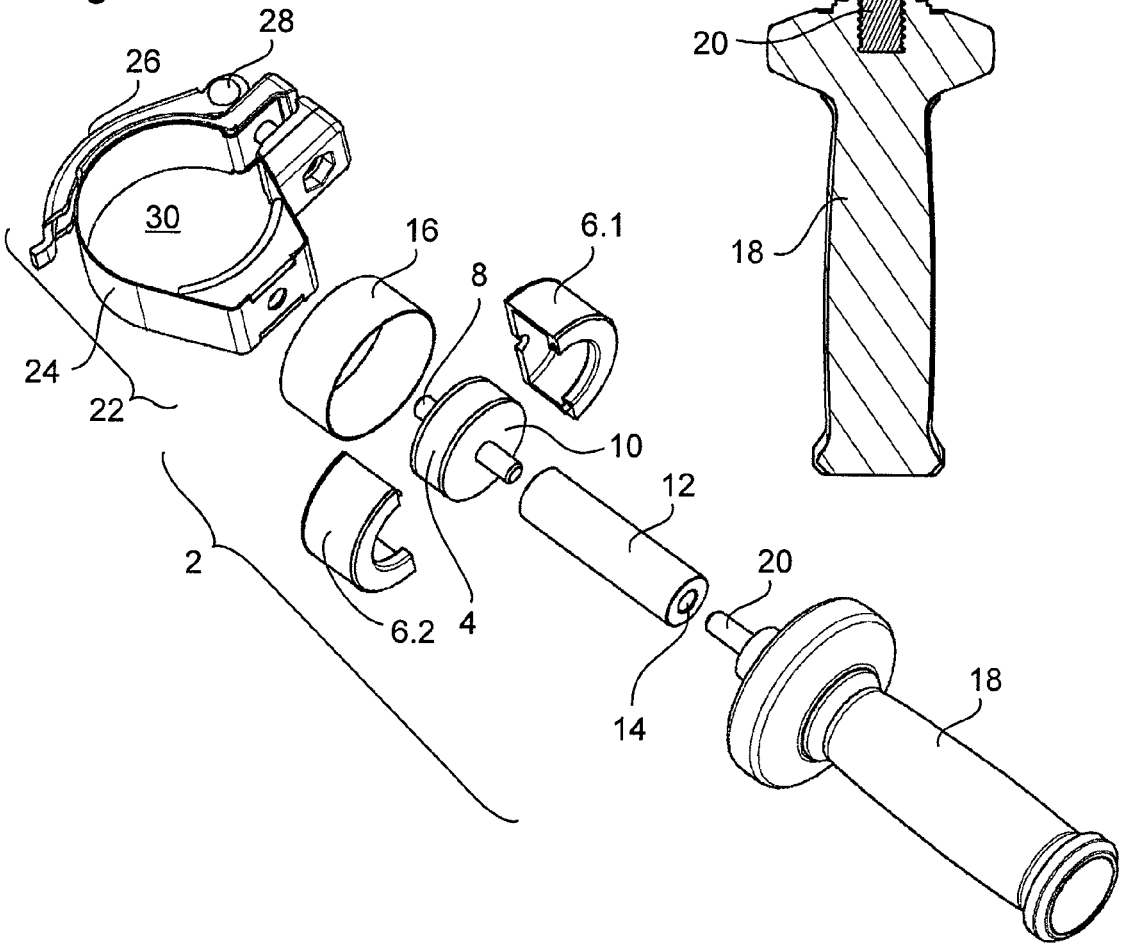
FIG. 3 shows an exploded view of the handle of FIG. 2.

FIG. 3 shows the handle shown in FIG. 2 in an exploded view. In the left part of FIG. 3, the attachment means 22 is shown with the open metallic ring 24, the space 30 defined by it, the clamping means 28 and the lever element 26.

The damper 2, already shown in FIG. 1, is formed contiguously therewith. Apart from the elastic element and the first and second connecting elements 8, 10, the two-part cladding 6 composed of two cladding parts 6.1 and 6.2 is shown. Each of the cladding parts 6.1, 6.2 substantially forms a half-cylinder barrow, which can receive the cylindrical elastic element 4 and the saucer-shaped bases of the connecting elements 8, 10 within. In the assembled state, both half-cylinder barrow-shaped cladding parts 6.1, 6.2 form the complete and substantially cylindrical cladding 6, which in its assembled state is held together by the metal ring 16.

As already shown in FIGS. 1 and 2, the distancing means 12 is attached to the second connecting element 10. The distancing means 12 is also cylindrically shaped, wherein the cylinder axis of the distancing means 12 is substantially aligned with the cylinder axis of the damping means 32. The diameter of the cylindrical distancing means 12 is substantially smaller than the first diameter of the damping means 32.

The handle means 18 is screwed to the distancing means 12 via recess 14 and a screw connection 20. The rotationally symmetrical handle means 18 is situated with its axis of symmetry substantially on the cylinder axis of the distancing means 12 and of the damping means 32.

Figure 4:
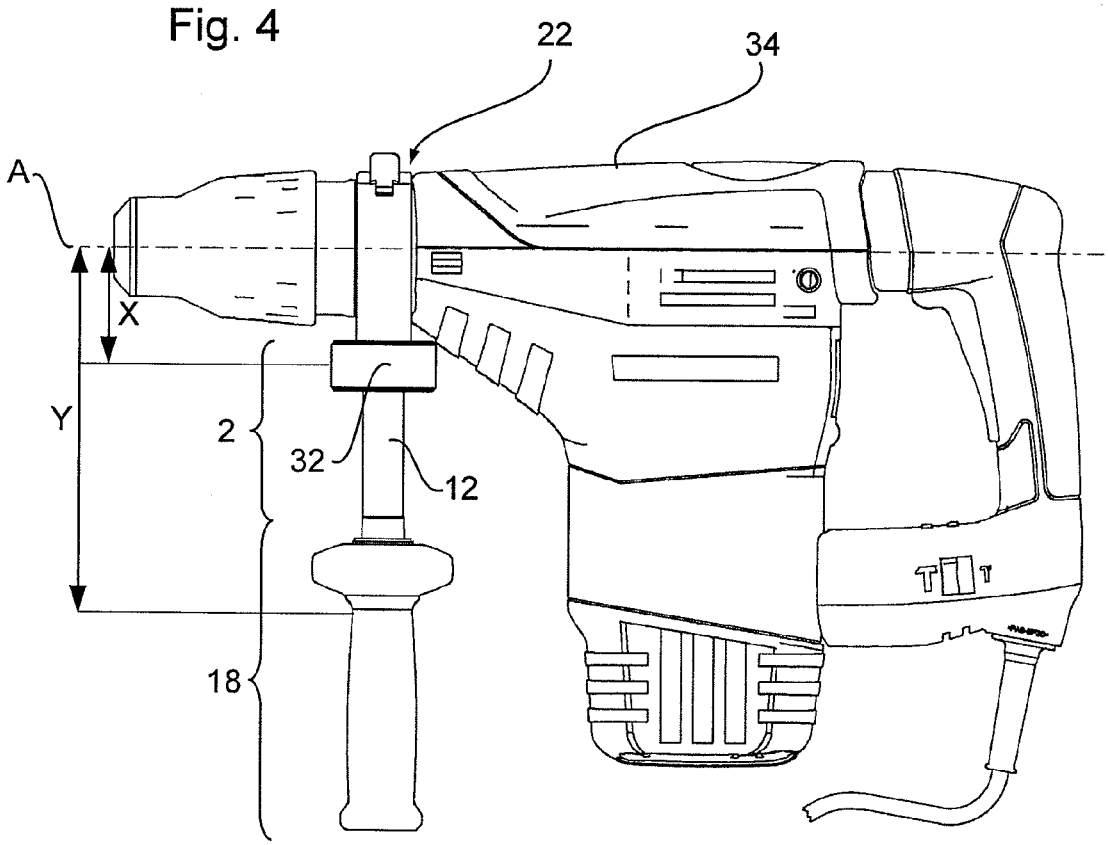
FIG. 4 shows a power tool having a handle with a damper.

FIG. 4 shows a power tool 34 according to an embodiment of the invention having a handle according to an embodiment of the invention, and comprising elements already shown and described in the previous figures. In particular, the handle comprises the damping means 32, the distancing means 12, the handle means 18 and the attachment means 22.

The attachment means 22 is arranged on the power tool 34 in such a way that an axis of vibration A of the power tool 34 is enclosed by the attachment means 22. The axis of vibration A of the power tool 34 is, in this example, formed by an axis along which the power tool 34, which is designed as a hammer drill, acts upon a substrate. The axis A runs centrally through the space 30 of the attachment element 22.

FIG. 4 shows that a first distance Y between the axis of vibration A of the power tool 34 and the handle means 18 is at least twice as large as a second distance X between the axis of vibration A of the power tool 34 and the damping means 32 of the damper 2. The distancing means 12 ensures that the distance of the handle means 18 from the damping means 32 is sufficiently large so that this ratio between the first distance Y and the second distance X is maintained. The first distance Y is measured from the axis of vibration A to a point on the handle means on which thumb and index finger meet when held in the usual manner. In order to ensure a comfortable use of the power tool 34, the damping element 32 is installed as close as possible to the housing of the power tool 34. Thus, with a handle means 18 provided as close as possible to the power tool 34 one may still ensure the inventive ratio between the two distances Y and X.

The power tool 34 shown in FIG. 4 may also be a drill or an impact drill instead of a hammer drill. Other power tools having an axis of vibration or having strong shocks or vibrations created in a defined direction or at a defined location, are also fundamentally suitable for application of the inventive damper.

The handle 18 may be connected, as in the present embodiment, to the power tool 34 by means of a clamping means, such as a clamping mechanism 22. In alternative, it is also possible that the handle is fixedly attached to the power tool. A screw fastening of the handle to the power tool 34 is conceivable, too, and the inventive damper 2 may also be subsequently fitted as distancing element between a handle already present on a power tool and this handle as long as the handle may be detached from the power tool. The mounting of the handle does not necessarily have to be performed so that an attachment element has to be aligned in the region of an axis of vibration, and it may be fixed at many different locations of the power tool 34.

In the embodiment described herein, the cladding 6 of the damper 2 not only serves as stopper, but also as tear-off-protection. If the elastic element 4 connecting the two connecting elements 8, 10 via their base portions with each other should tear due to age-related phenomena or overloading, the cladding 6 securely holds the handle and the power tool together. Due to the inventive metal ring 16, which may also be manufactured from a different material than metal, a failure of the cladding 6 within the limits conceivable upon use of the power tool can virtually be excluded.

The diameter of the cylindrical damping element 32 does not have to be larger than the diameter of the distancing means 12. It is also conceivable that such a damping means is designed integrally with the distancing means and/or the handle means. Also the attachment means may be integrally formed with the damper and the handle means. Depending on the tool, distancing means having different lengths may also be provided, and they allow an especially flexible and versatile application of the inventive damper in power tools.

What is claimed is:

1. A damper configured for mounting between a power tool having an axis of vibration and a handle, the damper comprising:

a damping arrangement comprising:

a first connecting element;

a second connecting element; and a cylinder having opposite first and second faces, wherein the first connecting element contacts the first face of the cylinder and the second connecting element contacts the second face of the cylinder, wherein the cylinder defines a damper axis extending perpendicular to the opposite first and second faces of the cylinder, wherein the cylinder is configured to damp vibration at the handle during operation of the power tool, and wherein the damper axis is non-coaxial with the axis of vibration defined by an axis of movement of a working portion of the power tool acting upon a substrate when the damping arrangement is mounted to the power tool;

a cladding element configured to receive the damping arrangement and to allow damping of an axial motion along the damper axis as well as tilting motions relative to the damper axis; and a spacer;

wherein the spacer is dimensioned so that the damper is mountable to the power tool such that a ratio of a first distance between the axis of vibration and the handle to a second distance between the axis of vibration and the damping arrangement is at least 2:1.

2. The damper of claim 1, wherein the cylinder comprises an elastic element.

3. The damper of claim 1, wherein the cladding comprises a stopper element configured to limit movement of the damping element.

4. The damper of claim 1, wherein the cladding comprises a multi-part cladding wherein the cladding comprises at least a first portion and a second portion, and a ring-shaped envelope surrounding the first and second portions.

5. The damper of claim 4, wherein the ring-shaped envelope comprises a metal ring.

6. The damper of claim 1, further comprising a clamping mechanism configured to allow the damper to be assembled to and removed from the power tool.

7. A power tool comprising:

a power tool body defining an axis of vibration along an axis of movement of a working portion of the power tool acting upon a substrate;

a handle connectable to the power tool body;

a damping arrangement comprising:

a first connecting element;

a second connecting element; and a cylinder having opposite first and second faces, wherein the first connecting element contacts the first face of the cylinder and the second connecting element contacts the second face of the cylinder, wherein the cylinder defines a damper axis extending perpendicular to the opposite first and second faces of the cylinder, wherein the cylinder is configured to damp vibration at the handle during operation of the power tool, and wherein the damper axis is non-coaxial with the axis of vibration defined by an axis of movement of a working portion of the power tool when the damping arrangement is mounted to the power tool; and a spacer;

wherein the spacer is non-coaxial with the axis of vibration and is interposed between the handle and the power tool body, the spacer is dimensioned so that a ratio of a first distance between the axis of vibration and the handle to a second distance between the axis of vibration and the damping arrangement is at least 2:1, and wherein the damping arrangement is configured for damping an axial motion along the damper axis as well as of a tilting motion relative to the damper axis.

8. The power tool of claim 7, wherein the power tool is one of a drill, an impact drill or a hammer drill.

9. The power tool of claim 7, wherein the damping arrangement, the spacer and the handle are manually detachable from the power tool by a clamping mechanism.

10. The power tool of claim 7, wherein the damping arrangement, the spacer and the handle are linearly arranged one after the other in this order.

11. The power tool of claim 7, wherein the damping arrangement, the spacer and the handle are connectable to one another through threaded connections.

* * * * *